United States Patent [19]

Kawaguchi et al.

[11] Patent Number: 4,953,335

[45] Date of Patent: Sep. 4, 1990

[54] DECORATIVE BOARD HAVING HOT-MELT RESIN JOINTS

[75] Inventors: Shiro Kawaguchi; Katsunori Kai, both of Osaka, Japan

[73] Assignee: Eidai Industry Co., Ltd., Osaka, Japan

[21] Appl. No.: 186,379

[22] Filed: Apr. 26, 1988

[51] Int. Cl.[5] ..... E04B 5/00

[52] U.S. Cl. ..... 52/384; 52/390

[58] Field of Search ..... 52/390, 384, 177, 573, 52/595, 98, 314, 588, 593

[56] References Cited

U.S. PATENT DOCUMENTS

| | | | |
|---|---|---|---|
| 885,751 | 4/1908 | Heaton | 52/390 |
| 2,088,230 | 7/1937 | Greenway | 52/390 |
| 2,123,409 | 7/1938 | Elmendorf | 52/390 |
| 2,491,498 | 12/1949 | Kahr | 52/392 |
| 2,860,385 | 11/1958 | Cohn | 52/390 |
| 3,084,403 | 4/1963 | Elmendorf | 52/727 |
| 3,527,004 | 9/1970 | Sorensen | 52/98 |
| 3,579,941 | 5/1971 | Tibbals | 52/390 |
| 3,717,247 | 2/1973 | Moore | 52/390 |
| 4,416,100 | 11/1983 | Troendle, Sr. | 52/390 |

FOREIGN PATENT DOCUMENTS

| | | | |
|---|---|---|---|
| 1147651 | 11/1957 | France | 52/390 |
| 54-21477 | 7/1979 | Japan . | |

*Primary Examiner*—David A. Scherbel
*Assistant Examiner*—Caroline Dennison
*Attorney, Agent, or Firm*—Morgan & Finnegan

[57] ABSTRACT

A flooring board assembly comprising a plurality of board parts, each board part having generally opposed tongue and groove formations thereon engageable with the groove and tongue formations, respectively, on an adjacent board part of the assembly. Each board part is further formed with a first notched surface below the tongue formation thereon and a second notched surface below the groove formation thereon. The corresponding first and second notched surfaces of any pair of adjacent board parts form a groove-like cavity upon engagement of the corresponding tongue and groove formations thereof. Each groove-like cavity is filled with a hot-melt resin which adheres to the corresponding first and second notched surfaces thereof. The corresponding first and second notched surfaces of each groove-like cavity cooperate to expand or contract said resin therewith in response to upward or downward flexure, respectively, of one of the corresponding pair of engaged board parts so as to conform the flooring board assembly to an uneven floor system.

4 Claims, 2 Drawing Sheets

DECORATIVE BOARD HAVING HOT-MELT RESIN JOINTS

FIELD OF THE INVENTION

The present invention relates to a decorative board comprising plural small decorative board parts, which can directly be applied to a floor with an uneven surface such as a concrete floor, etc., and in particular, to a decorative board having a hot-melt resin in joints of plural small decorative board parts in which the said decorative board parts are notched on the side of the back surface in the both side edges extending to the longitudinal direction and the grooves formed by the respective notches of the butt-jointed decorative board parts are filled with a flexible hot-melt resin.

BACKGROUND OF THE INVENTION

Some conventional butt-jointed decorative boards are composed of plural small decorative board parts which are butt-jointed to each other, but these are constructed by merely butting the edges of the decorative board parts in the longitudinal direction and jointing the same, or alternatively, a tongue is formed on one edge of the respective decorative board parts in the longitudinal direction while a narrow and long groove is formed on the other edge of the said board parts, the said groove being able to be engaged with the tongue of a different decorative board part, and the decorative board parts thus having the said tongue and groove are merely jointed in the tongue and groove parts.

However, since these conventional merely butt-jointed decorative boards do not have flexibility or bendability, these are defective in the point that the joints are often released to give gaps between the jointed parts when the decorative board is directly applied to a floor with an uneven surface such as a concrete floor, etc. If the board is tried to be applied to such uneven floor so as to give no gaps between the jointed parts, the work would be extremely difficult and, as a result, further gaps would be formed by the application of the board.

SUMMARY OF THE INVENTION

Accordingly, the object of the present invention is to overcome the above-mentioned defects and to provide a decorative board comprising plural decorative board parts as butt-jointed, in which the respective decorative board parts are made bendable at the joints so that the decorative board can directly, surely and firmly be applied to a floor with an uneven surface such as a concrete floor, etc., the decorative board applied being suitably fitted the uneven surface of the floor.

In order to attain the said objects, the subject matter of the present invention is to provide a decorative board formed by butt-jointing plural small decorative board parts via a hot-melt resin as applied to the joints of the parts, characterized in that the respective decorative board parts are notched on the side of the back surface in the both side edges extending to the longitudinal direction, the grooves formed by the respective notches of the said butt-jointed decorative board parts being filled with a flexible hot-melt resin, and the respective decorative board parts have a narrow and long tongue as formed on one side edge of the longitudinal direction and a narrow and long groove on the other side edge thereof, the said groove being able to be engaged with the tongue of another decorative board part. The decorative board of the present invention can be directly applied even to a floor with an uneven surface, since the sheet can suitably fit the uneven surface of the floor.

Specifically, the decorative board of the present invention comprises plural decorative board parts which have a flexible and soft thermoplastic (hot-melt) resin in the notches formed on the side of the back surface in the both joint edges of the longitudinal direction, so that the plural decorative board parts are butt-jointed with the said hot-melt resin. Further, the small decorative board parts for constituting the decorative board of the present invention have a narrow and long tongue on one side edge extending to the longitudinal direction and a narrow and long groove on the other side thereof so that the said groove can be engaged with the tongue of another decorative part. Conveniently, since the hot-melt resin can easily expand and contract and the tongue can suitably be engaged with the groove, the resulting decorative board is freely flexible at the joints of the respective board parts.

DESCRIPTION OF PREFERRED EMBODIMENTS

Preferred embodiments of the present invention are described in detail with reference to drawings, which, however, are not intended to limit the present invention in any way.

Figure 1:
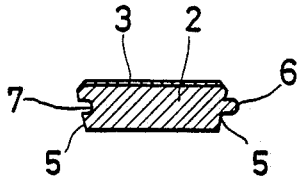
FIG. 1 shows a sectional view of a decorative board part to be used for formation of one embodiment of the decorative board of the present invention.
Figure 2:
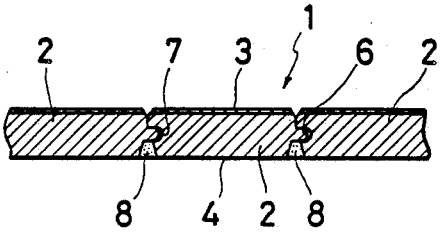
FIG. 2 shows a sectional view of one embodiment of the decorative board of the present invention.
Figure 3:
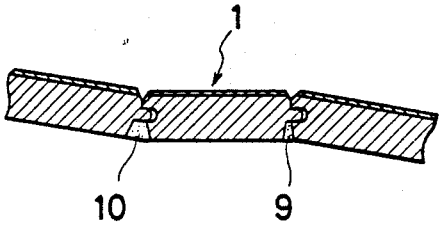
FIG. 3 shows a sectional view to illustrate the state of the decorative board of FIG. 2 which has been bent.

FIG. 1, FIG. 2 and FIG. 3 are referred to, which illustrate an embodiment of a decorative board (1) of the present invention. The decorative board (1) is composed of small decorative board parts (2). The decorative board part (2) is composed of a printed or embossed decorative surface (3) and a back surface (4) which is to be directly stuck to the surface of a concrete floor, etc., and the back surface (4) has notches (5) formed in the both side edges extending to the longitudinal direction. Further, the decorative board part (2) has a tongue (6) on one end of the longitudinal direction and has a groove (7) in the other end thereof, the groove (7) being able to be engaged with a tongue (6) of another decorative board part (2). As shown in FIG. 2, plural decorative board parts (2) are butted and jointed and the grooves formed by the notches (5) are filled with a flexible and soft hot-melt resin (8). As shown in FIG. 3, the decorative board (1) can be bent; and when the board (1) is bent in such manner that the front surface side of the board (1) is protruded, the hot-melt resin (8) is thereby contracted as shown by (9); but when the board (1) is bent in such manner that the back surface of the board (1) is protruded, the hot-melt resin (8) is on the contrary expanded as shown by (10). The flexible hot-melt resin for use in the present invention includes ethylene-vinyl acetate series resins, urethane series resins, polyester series resins, etc. Although urethane series resins and polyester series resins include hard resins, only those which have a determined softness are limitatively used in the present invention. Specific examples of the resins for use in the present invention include "MU-80" (synthetic rubber series resin) by Konishi, "HM-370S" (rubber-olefin series resin) by Cemedine and "Hamatite M-6080" (synthetic rubber series resin) by Yokohama Rubber. When the said resin is filled in the grooves formed in the decorative board parts, the said hot-melt resin is first heated at 170° C. to 190° C. and applied to the grooves with a spray gun, and then left at room temperature to be cooled, whereby the resin is adhered to the back surface of the decorative board parts. It is a matter of course that a flexible sheet may be stuck over all the back surface of the thus jointed decorative board part, if desired. As the sheet to be suitably used for the said purpose, there may be mentioned a rubber sheet as well as a foamed synthetic resin sheet of polyethylene, polystyrene, etc. The thickness of the said sheet is preferably from 1 to 6 mm. If the thickness is less than 1 mm, the sheet could not display a sufficient cushion effect and this could not fit an uneven floor. On the other hand, if the thickness exceeds 6 mm, the depression of the sheet would be too much and the feeling upon walking on the floor with the sheet would be bad.

Figure 8:
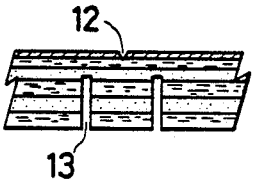
Figure 9:
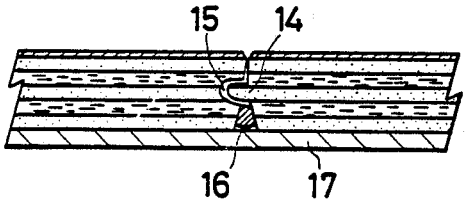
FIG. 9 shows an enlarged A-A sectional view of FIG. 4.

FIG. 4 to FIG. 9 explain other embodiments of the present invention, in which (11) is a small decorative board part which has a desired decoration on the surface of a board material such as plywood, particle board, hard board, etc. For decoration, for example, a projecting sheet or a decorative resin sheet is stuck on a base board, or a base board is painted or printed with patterns. For the purpose of improving the abrasion-resistance, the surface of the said decorative sheet can be coated with a transparent varnish layer containing alumina or silicon carbide. The small decorative board part (11) has plural grooves (12) on the surface in the perpendicular direction. The shape of the groove (12) may be anyone of V-groove, U-groove, square-groove, etc. The small decorative board part (11) further has notch(es) (13) on the back surface thereof. The notch (13) is preferably cut into the middle of the thickness of the small decorative board part (11). The notch (13) is generally formed with a circular saw machine, which, however, is not limitative. Regarding the position of the notch (13) to be formed, various cases are possible, for example, the notch (13) may be formed in the position which is almost opposite to the position of the groove (12) (FIG. 7), or the notch (13) may also be formed in the positions which are almost near the both sides of the groove (12) (FIG. 8). (11) is a projecting sheet and (17) is a 5-layered plywood. When the notch is formed in the position which is almost opposite to the position of the groove (12), the small decorative board part is extremely flexible at the said part with the notch. On the other hand, if the notches are formed in the positions which are almost near the both sides of the grooves (12), the depth of the notches (13) can be deep, and therefore the case is advantageous in that the small decorative board part (11) can be bent more easily and if this is bent along the uneven surface of the floor to which the board was applied, the surface of the board as bent may be curved and the position of the notch as bent is hardly conspicuous. (14) is a tongue and (15) is a groove for the tongue (14). The position is shown in the drawing by means of the dotted line. The tongue is formed so as to be loosely engaged with the groove (15), and when the adjacent rectangular decorative board parts are jointed, the tongue (14) is loosely engaged with the groove (15) with a noticeable gap therebetween as shown in FIG. 9 so that the respective rectangular decorative sheet parts can freely be bent at the jointed part. In addition, the respective decorative board parts are notched on the side of the back surface in the both edges of the longitudinal direction, and the grooves formed by the respective notches of the butt-jointed decorative board parts are filled with a hot-melt resin (16).

Figure 4:
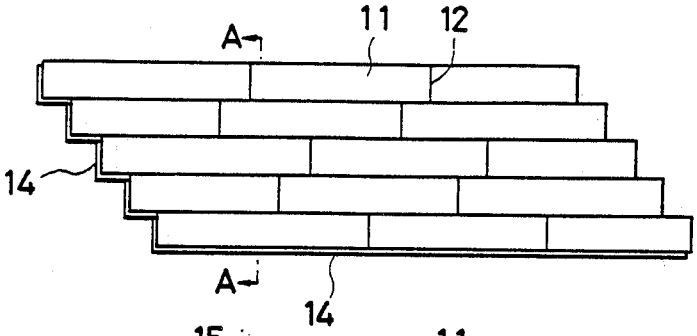
FIG. 4 shows a plane view of another embodiment of the present invention.
Figure 5:
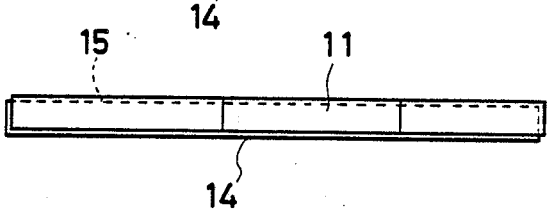
FIG. 5 shows a plane view of small decorative board parts.
Figure 6:
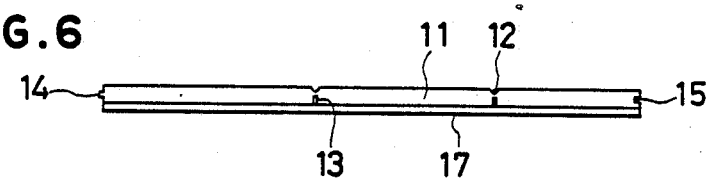
FIG. 6 shows a front view of FIG. 5.
Figure 7:
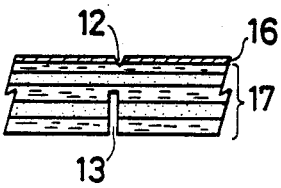
FIG. 7 and FIG. 8 each are a sectional view to show the position of notch(es).

The small decorative board parts (11) are combined in series in the longitudinal direction with being somewhat shifted in the said direction to form a broad and large decorative board, as shown in FIG. 4, whereupon the grooves (12) are positioned to be staggered. FIG. 9 shows an enlarged sectional view of a broad decorative board formed from small decorative board parts with a hot-melt resin. The back surface of the thus formed decorative board having a broad size has a flexible substrate (17) with almost the same size, as stuck thereto. As the flexible substrate (17), there may be mentioned a rubber foam, a polyethylene series foam resin sheet, a polyurethane series foam resin sheet and the like resin sheets.

The following examples are intended to illustrate the present invention but not to limit it in any way.

EXAMPLE 1

Projecting sheet-laminated plywoods (width 60 mm, length 900 mm, thickness 12 mm) were worked to have tongues and grooves around the four edges thereof, and the thus prepared small decorative sheet parts were engaged in series in the longitudinal direction with being somewhat shifted in the said direction. A flexible ethylene-vinyl acetate series hot-melt resin was injected into the gaps between the jointed parts from the back surface of the sheet, to obtain a decorative board.

EXAMPLE 2

A 2 mm thick synthetic polyethylene series foam resin sheet was stuck to the back surface of the decorative board of Example 1 to obtain a decorative board of another type.

EXAMPLE 3

Two grooves were formed on the surface of the respective plywoods of Example 1 in the perpendicular direction and notches were also formed on the back surface thereof in the position just below the said grooves. The depth of the notches reached more than the middle of the thickness of the plywood. These were jointed, and a 1 mm thick synthetic polyurethane series foam resin sheet was stuck to the back surface of the sheet to obtain a decorative sheet.

EXAMPLE 4

A decorative board of another type was manufactured in the same manner as Example 1, except that the positions of the notches to be formed on the back surface of the plywood were changed to those which were almost near the both sides of the grooves formed on the surface of the plywood.

On the basis of the illustration as above, the effect of the present invention can be summarized as follows. The decorative board of the present invention has a hot-melt resin in the joints of the respective parts and the hot-melt resin can be expanded and contracted in accordance with the external force as imparted to the board. Accordingly, the decorative board is freely bendable, and therefore, this can properly be applied even to a floor with an uneven surface such as a concrete floor, as this may correspondingly fit even the uneven surface. Further, the decorative board can extremely easily be applied to the surface of an uneven floor such as a concrete floor without release of the constitutional parts of the decorative board and without remaining of any unnatural residual stress in the decorative board.

While the invention has been described in detail and with reference to specific embodiments thereof, it will be apparent to one skilled in the art that various changes and modifications can be made therein without departing from the spirit and scope thereof.

What is claimed is:

1. A flooring board assembly comprising:

a plurality of board parts, each said board part having a front surface and a back surface, the back surfaces of the assembled said plurality of board parts being coated with a flexible sheet;

each said board part providing generally opposed tongue and groove formations thereon engagable with the groove and tongue formations, respectively, on an adjacent said board part of said assembly, each said board part being further formed with a first notched surface below said tongue formation thereon and a second notched surface below said groove formation thereon, the corresponding said first and second notched surfaces of any pair of adjacent said board parts forming a groove-like cavity upon engagement of the corresponding said tongue and groove formations thereof; response to upward or downward flexure, respectively, of one of the corresponding pair of engaged said board parts so as to conform said flooring board assembly to an uneven floor system; and each said board part being further formed with a plurality of perpendicular grooves on the front surface thereof and a plurality of notches on the back surface thereof.

2. A flooring board assembly according to claim 1, wherein one of said plurality of notches is positioned substantially opposite each of said plurality of perpendicular grooves.

3. A flooring board assembly according to claim 1, wherein one of said plurality of notches are positioned on opposed sides of each of said plurality of perpendicular grooves.

4. A floor board assembly according to claim 1, wherein said plurality of board parts forming said flooring board assembly are longitudinally connected such that each of said plurality of perpendicular grooves formed on each said board part is positioned in staggered fashion relative to each of said plurality of perpendicular grooves formed on any adjacent said board part.

* * * * *

UNITED STATES PATENT AND TRADEMARK OFFICE

CERTIFICATE OF CORRECTION

PATENT NO. : 4,953,335

DATED : September 4, 1990

INVENTOR(S) : Shiro Kawaguchi and Katsunori Kai

It is certified that error appears in the above-identified patent and that said Letters Patent is hereby corrected as shown below:

On the title page:

In the Abstract, line 17, "therewith" should read --therewithin--

Column 6, line 7, after "thereof" insert --each said groove-like cavity being filled with a hot-melt resin which adheres to the corresponding said first and second notched surfaces thereof, said corresponding first and second notched surfaces of each said groove-like cavity cooperating to expand or contract said resin therewithin in--

Column 6, line 24, "floor" should read --flooring--

Signed and Sealed this

Seventh Day of January, 1992

*Attest:*

HARRY F. MANBECK, JR.

*Attesting Officer*

*Commissioner of Patents and Trademarks*